US005135167A

United States Patent [19]

Ringer

[11] Patent Number: 5,135,167

[45] Date of Patent: Aug. 4, 1992

[54] SNOW MAKING, MULTIPLE NOZZLE ASSEMBLY

[75] Inventor: Thomas R. Ringer, Gloucester, Canada

[73] Assignee: J. A. White & Associates Ltd., O/A Delta Engineering, Ottawa, Canada

[21] Appl. No.: 688,480

[22] Filed: Apr. 22, 1991

[30] Foreign Application Priority Data

Apr. 27, 1990 [CA] Canada ..... 2015646

[51] Int. Cl.[5] ..... F25C 3/04

[52] U.S. Cl. ..... 239/14.2; 239/428; 239/430

[58] Field of Search ..... 239/14.2, 2.2, 428, 239/430, 433

[56] References Cited

U.S. PATENT DOCUMENTS

| | | | |
|---|---|---|---|
| 2,676,471 | 4/1954 | Pierce | 62/172 |
| 3,464,625 | 9/1969 | Carlson | 239/2.2 |
| 3,494,559 | 2/1970 | Skinner | 239/2.2 |
| 3,829,013 | 8/1974 | Ratnik | 239/14.2 |
| 3,831,844 | 8/1974 | Tropeano et al. | 239/14.2 |
| 4,465,230 | 8/1984 | Ash | 239/2.2 |
| 4,813,597 | 3/1989 | Rumney et al. | 239/14.2 |

FOREIGN PATENT DOCUMENTS

| | | | |
|---|---|---|---|
| 1128328 | 7/1982 | Canada | 62/11 |

*Primary Examiner*—Andres Kashnikow
*Assistant Examiner*—Lesley D. Morris
*Attorney, Agent, or Firm*—Ronald G. Bitner

[57] ABSTRACT

A snow making, multiple nozzle assembly is provided comprising a tubular casing having an upstream end wall and an outwardly bulging downstream wall containing a plurality of snow making, supersonic, air expansion and liquid atomizing nozzle orifices circumferentially spaced therearound with radially inwardly extending air grooves therebetween in the outer, bulging surface. A tube plate partitions the casing interior into an upstream water compartment and downstream air compartment, and for each snow making nozzle orifice contains a water jet nozzle for directing a water jet into a central portion of that snow making nozzle orifice. Pressurized water fed into the water compartment causes water jets in each of the snow making nozzle orifices while pressurized air fed to the air compartment causes a jacket of air to surround the water jets entering the snow making nozzle orifice. The water exits from the snow making nozzle orifices as fine droplets which form into snow. One of the snow making nozzle orifices may replaced by a snow nucleating nozzle orifice.

9 Claims, 2 Drawing Sheets

SNOW MAKING, MULTIPLE NOZZLE ASSEMBLY

FIELD OF THE INVENTION

This invention relates to a snow making multiple nozzle assembly.

BACKGROUND OF THE INVENTION

In the making of snow for winter sport activities such as down hill skiing the most prevalent means is to use compressed air and water which are supplied to so-called snow guns or nozzles for the atomizing, projection and distribution of the resulting product. In most of the existing nozzles the compressed air and water are mixed internally within the body of the nozzle and are discharged from the nozzle outlet as a mixture. The compressed air provides the energy source for water atomization and also supplies a significant proportion of the momentum necessary to project the droplets and distribute them as frozen particles on the ski slope. The compressed air may serve a secondary purpose in snow making. Depending on the expansion process the compressed air may be cooled and therefore contribute to the snow making by removal of heat from the water. The two phase jet issuing from the nozzle will induce secondary cold ambient air to mix with the primary stream. It is the secondary air and the surrounding atmosphere that provide the largest proportion of the required cooling to convert the water droplets to ice particles.

The ratio of compressed air to water used in snow making can change by more than an order of magnitude even for the same nozzle since the snow making process is highly dependent on the ambient temperature and the humidity of the air. In North America it is customary to quote the ratio in terms of scfm (standard cubic feet per minute) of air per USgpm (US gallons per minute) of water. For calculation purposes a mass ratio of compressed air to water is more meaningful and is used in this application. The practical limits of the mass ratio are 0.01 to 0.5 which would include very efficient units operating at temperatures of −20° C. and colder and relatively inefficient units operating at temperatures approaching 0° C. For comparison a mass ratio of 0.10 is equivalent to a ratio of 11:1 scfm/USgpm. The pneumatic method of snow making is an energy intensive process. The typical compressed air plant supplying air at 100 psig will pump approximately 4.5 scfm per horsepower input, thus for the mass ratio case of 0.10 an energy input of 2.5 hp per gallon water pumped per minute would be required for the compressed air. At the high limit ratio of 0.5 this would mean an input of 12.5 hp per gpm for compressed air.

In order to reduce the energy input for snow making while retaining the compressed air method there is a need to develop more energy-efficient snow making nozzles. The physical processes required of the snow making nozzle are atomization of the water stream and projection of the air-Water mixture with a minimum loss of momentum.

For a specific nozzle, the degree of atomization attained is a function of the supply pressure of the fluids and the mass ratio of the air to water. The mean size of droplets required for snow making depends on several factors including the ambient dry bulb and wet bulb temperatures, the wind velocity and the time of flight of the droplet, all of which affect the heat transfer processes involved. As the mean droplet size is reduced, by increasing the air/water mass ratio, the available surface area increases for a given quantity of water. An increased surface area results in a higher heat transfer within a given time period. At ambient freezing temperatures just below 0° C. the droplet size must be minimized so that a high surface area is provided to compensate for the lower heat transfer rate resulting from the small temperature differential available. Smaller droplets also have a lower terminal velocity and thus from a given height, the apogee of their flight, the smaller droplets take longer to contact the ground. The longer time of flight allows for a greater heat transfer.

In the late 1930's a research work was carried out in Japan on the atomizing of fluids by compressed air from which it was established that the droplet sizes produced by internal mix nozzles was a function of the difference in velocity, the slip velocity, between the liquid and the air. The formula developed by Nukiyama and Tarasawa, Experiment On The Atomization Of Liquid By Means Of An Air Stream, Trans. Soc. Mech. Engrs. Japan, Vol. 4, 1938, pp. 86–93, has remained in use although it has been shown that this empirical formula is not dimensionally consistent. Subsequent work by others has extended the application of the formula to larger nozzles with higher flow rates and experimentally to an external atomizing means with a supersonic air nozzle, Atomization Of Liquid By Supersonic Air Jets, Industrial and Engineering Chemistry, Vol. 47, No. 1, 1955, pp. 23–28. It has been demonstrated that higher differential velocities result in smaller droplet sizes. Droplet size also is a linear function of the nozzle orifice diameter when other factors are constant, therefore to increase capacity it is preferable to increase the number of nozzles in preference to increasing the size of a nozzle, Airblast Atomization: The Effect Of Linear Scale On Mean Drop Size, ASME, 1980, Gas Turbine Conf., Paper 80GT74.

With internal mix nozzles there are several methods by which the air and water can be mixed. A large low velocity mixing chamber can be provided into which the air and water must be admitted at approximately the same pressure. Numerous methods have been developed with the aim of producing a homogeneous mixture. From the mixing chamber the air-water mixture is discharged to the atmosphere generally through a converging nozzle. When air is discharged to the atmosphere through a convergent nozzle the maximum velocity that can be attained by the air is equal to the speed of sound and this occurs at the outlet orifice, Compressed Gas Handbook, NASA, SP 3045, 1969. The speed of sound in a homogeneous air-water mixture is much lower than that in air alone thus the maximum velocity that can be attained by the mixture is lower. If the mixture is not homogeneous as is often the case then the two fluids may exit at different velocities. Even with premixing before a convergent or a cylindrical nozzle some separation may take place and usually the flow is coaxial with an inner core that is predominantly gaseous while the outer annular flow is primarily the liquid component. This is one of the known modes of two phase flow, One dimensional Two Phase Flow, McGraw-Hill Book Co., New York, 1969.

For a homogeneous mixture the friction loss is much greater than for either component. For non-homogeneous mixtures that which is predominantly water in contact with the boundary wall has a higher friction than one which is predominantly gaseous at the wall. This would suggest that from an energy efficiency aspect a non-homogeneous mixture with air in contact with the wall would be the preferred mode. One of the methods used in the atomizing of water is the sheet forming process as an initial phase. Water is formed into a sheet on a surface and is then accelerated there by reducing the film thickness until ultimately ligaments and then droplets form. In air atomizing nozzles using the sheet forming technique a high air velocity is desirable in order to provide for the acceleration of the water film. Another method of atomizing water is based on jet instability, Experiments On Liquid Jet Instability, Journal Of Fluid Mechanics, Vol. 40, Part 3, 1970, pp. 495–511, and differential velocity between the water and the surrounding air. This is a method used by some face mixing and external mixing nozzles. These nozzles generally use convergent coaxial air nozzles and thus are limited to the velocity of sound for the discharge air.

SUMMARY OF THE INVENTION

In order to improve the efficiency of snow making nozzles the present system uses a number of physical principles in such a manner that less energy is required for the process than is currently needed by existing apparatus. For the pneumatic snow making process compressed air is commonly supplied at 100 psig although some of the newer installations are providing compressed air at 150 psig. When used in the snow making process, the expansion of the compressed air from supply pressure to atmospheric pressure may provide some refrigeration, depending upon the expansion process. An ideal adiabatic expansion will provide the maximum refrigeration, Elementary Engineering Thermodynamics, McGraw-Hill Book Co., New York, 1947. On the other hand, the applicant has found that if the pressure drop is the result of a high friction process then the expansion may produce insignificant amounts of refrigeration. When the expansion process is limited to a discharge velocity equivalent to the speed of sound then the adiabatic temperature drop obtained is much less than when expansion into the supersonic range takes place. Thus to maximize the refrigerating effect from the compressed air in snow making, the applicant has found that it is essential to expand the high pressure air to atmospheric pressure in a supersonic nozzle, i.e., a convergent-divergent nozzle, so proportioned that the air in the divergent section will increase in speed from the sonic velocity at or near the throat as the further expansion takes place. With this method, as compared to a convergent nozzle in which only sonic velocity is attained or a convergent-divergent nozzle in which the velocity decreases in the divergent section, the applicant has found that the refrigeration capacity is greater.

While increasing the refrigerating capacity of a snow making nozzle is beneficial to the overall process the primary purpose of the applicant for using a supersonic nozzle in snow making is to derive the benefit from a higher differential velocity between the air and the water. Here the advantage is two-fold, a higher differential velocity produces a smaller droplet at a given mass ration, which gives greater heat dissipation and thus allows a lower mass ratio at a given droplet size, i.e., more water can be atomized at a given air flow. The second benefit is that the higher air velocity at the same air mass flow results in a greater available momentum thus assisting in the projection and distribution of the droplets.

There are a number of ways in which water might be introduced into a supersonic nozzle. An annular water film might be applied to the surface of the convergent portion of the nozzle and the Coanda effect relied upon for the water to flow on the converging and diverging surfaces of the nozzle. A jet of water can be introduced a short distance upstream of the throat by a coaxial water nozzle. As reported by Amick et al, coaxial bodies, Menard inserts, may be installed on the centre line of supersonic nozzles, the result of which is an increase in the velocity attained by the nozzle, On Menard Inserts In Supersonic Nozzles, Journal of the Aeronautical Sciences, Sept., 1957, pp. 175–181. The applicant has found that a coherent water jet will act as a fluid Menard insert for a short distance until the high differential velocity and the supersonic shock waves disrupt the water stream. The applicant has also found that a supersonic nozzle with a central water jet needs to be limited in size in order to obtain small drops at high efficiency and so a large flow capacity can best be obtained by multiple orifice nozzles.

According to the present invention there is provided a snow making, multiple nozzle assembly comprising:

a) a tubular casing, b) an upstream end wall sealing an upstream end of the casing, c) a downstream end wall sealing a downstream end of the casing, the downstream end wall having a plurality of snow making, supersonic, air expansion and liquid atomizing, nozzle orifices, each snowmaking nozzle orifice extending outwardly through the end wall, to an outlet end thereon, along a longitudinal axis which is inclined radially outwardly at an angle in the range of about 5° to 15° to a central axis around which the snow making, nozzle orifices are circumferentially spaced, each snow making, nozzle orifice having a convergent, cone-shaped inlet portion with an obtuse included angle, an intermediate throat portion, and a divergent, cone-shaped outlet portion with an acute included angle, d) a tube plate in the casing and dividing the interior thereof into an upstream water compartment, and a downstream air compartment to the snow making, nozzle orifices, the tubeplate having, for each snow making nozzle orifice a circumferentially spaced water jet nozzle aligned therewith, each water jet nozzle having an outlet orifice for, in operation, directing a coherent water jet through the air compartment and along the longitudinal axes of and into a central portion of the snow making, nozzle orifice associated therewith, e) inlet means communicating with the water compartment for receiving pressurized water, and f) inlet means communicating with the air compartment for receiving pressurized air.

The downstream end wall may include cone-shaped outer surface which is symmetrical about the said central axis.

In the preferred embodiment the downstream end wall includes a plurality of ventilating air passages for allowing passage of secondary air to a region downstream and radially inward of the nozzle outlets. The ventilating air passages may be in the form of radial grooves in the downstream end wall.

The nozzle assembly may also comprise a snow nucleating nozzle orifice extending outwardly through the downstream end wall, to an outlet end thereof, along a longitudinal axis which is inclined radially outwardly at an angle in the range of about 5° to 15° to the said central axis around which the snow making and the snow nucleating nozzle orifices are circumferentially spaced, the snow nucleating nozzle orifice having a narrow bore relative to the bores of the snow making nozzle orifices, and having a convergent, cone-shaped inlet portion with an obtuse included angle, an intermediate throat portion, and a divergent, cone-shaped outlet portion with an acute included angle.

The means for delivering pressurized air to the compartment may comprise an air inlet centrally located in the upstream wall, and a pipe centrally located in the water compartment and connecting the air inlet to a central opening in the tube plate.

The water jet nozzles may each comprise a water tube having an upstream tapering bore which reduces in cross-sectional area towards a downstream, elongated portion of substantially constant cross-section for, in operation, directing a narrow jet of water into a central portion of the snow making, nozzle orifice associated therewith.

BRIEF DESCRIPTION OF THE DRAWINGS

In the accompanying drawings which illustrate, by way of example, embodiments of the present invention.

DESCRIPTION OF THE PREFERRED EMBODIMENT

Figure 1:
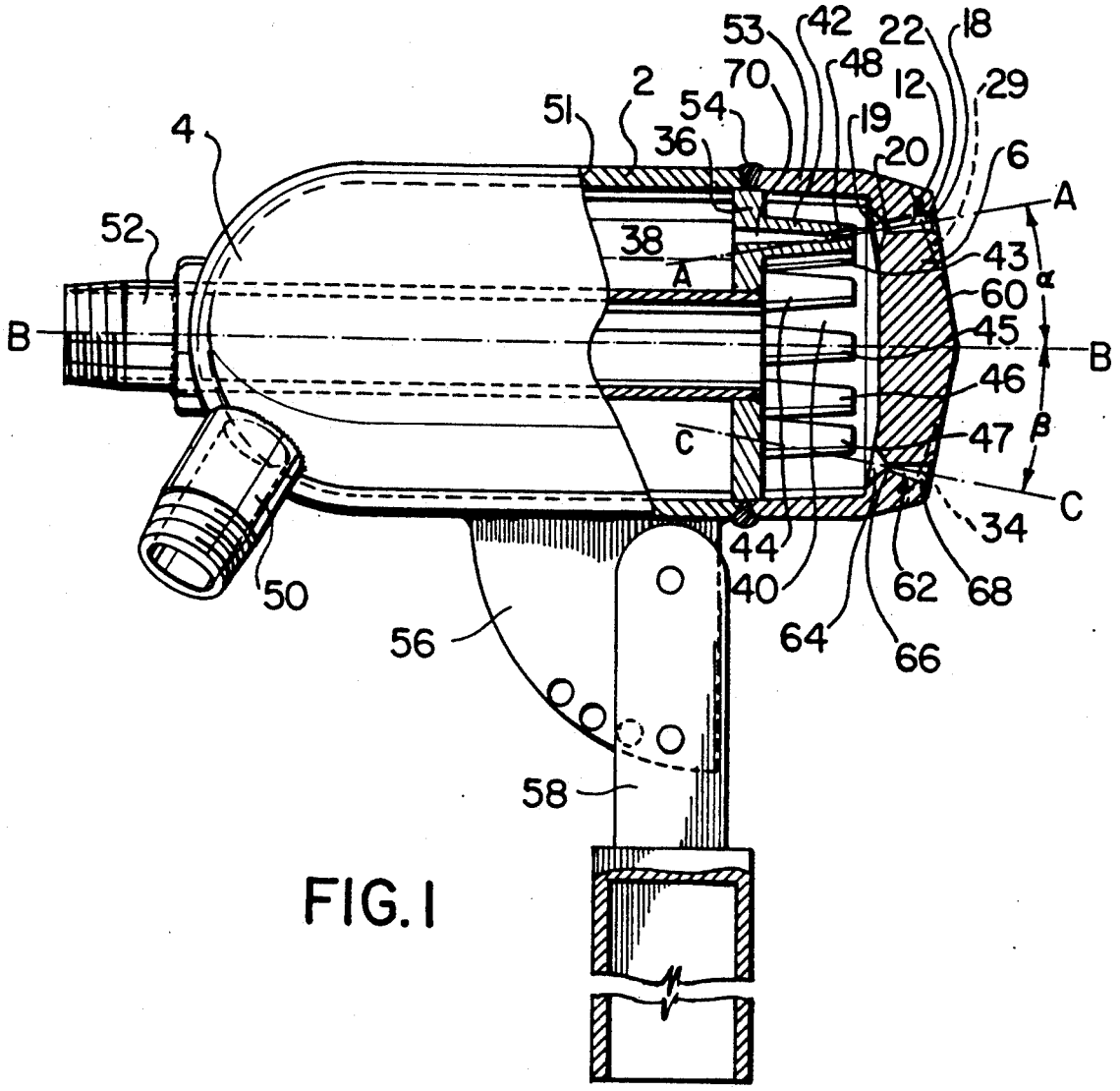
FIG. 1 is a partially sectional end view of a snow making multiple nozzle assembly along I—I, FIG. 2, and, FIG. 2 is an end view of FIG. 1.
Figure 2:
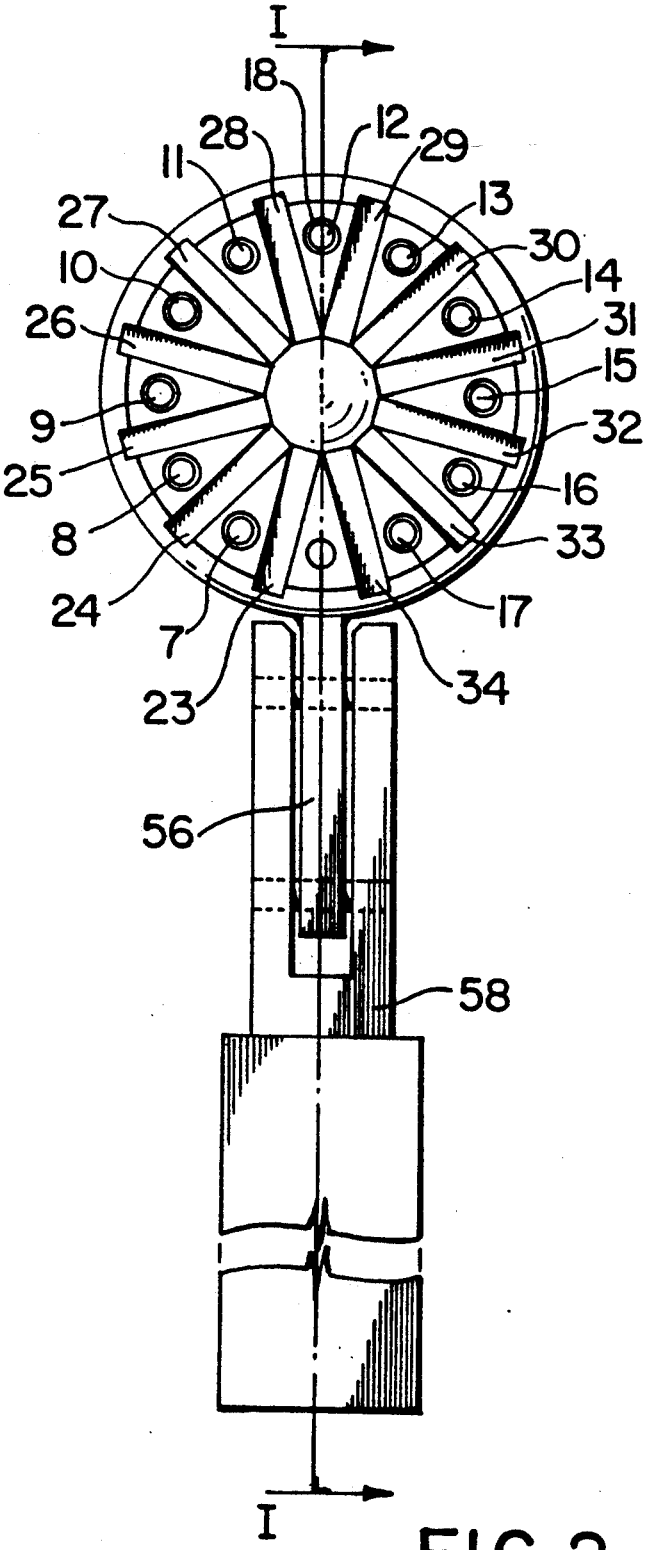

In FIGS. 1 and 2 there is shown a snow making, multiple nozzle assembly comprising:

a) a tubular casing 2, b) an upstream end wall 4 sealing an upstream end of the casing 2, c) a downstream end wall 6 for sealing a downstream end of the casing 2, the down-stream end wall 6 having a plurality of snow making, supersonic, air expansion and liquid atomizing, nozzle orifices 7 to 17 extending outwardly through the end wall, to an outlet end thereof, such as outlet end 18, along a longitudinal axis, such as axis AA, which is inclined radially outwardly at an angle in the range of about 5° to 15° to a central axis BB around which the snow making, nozzle orifices 7 to 17 are circumferentially spaced, each snow making, nozzle orifice 7 to 17 having, as shown for snow making nozzle orifice 12, a convergent, cone-shaped inlet portion, such as portion 19, with an obtuse included angle, an intermediate throat portion, such as portion 20, and a divergent, cone-shaped outlet portion, such as portion 22, with an acute included angle, d) a tube plate 36 in the casing 2 and dividing the interior thereof into an upstream water compartment 38, and a downstream air compartment 40 to the snow making, nozzle orifices 7 to 17, a circumferentially spaced water jet nozzle, such as those designated 42 to 47, aligned therewith, each water jet nozzle having, as shown for water jet nozzle 42, an outlet orifice 48 for, in operation, directing a coherent water jet through the air compartment 40 and along the longitudinal axes AA of and into a central portion of the snow making, nozzle orifice 12 associated therewith, e) inlet means 50 communicating with the water compartment 38 for receiving pressurized water, and f) inlet means 52 communicating with the air compartment 40 for receiving pressurized air.

The cylindrical casing 2 is in two parts 51 and which are welded together with the tube plate 36 between them, by a weld 54. A mounting plate 56 is welded to the casing part 51 and is pivotally attached to a support 58 so that the snow making nozzle orifices 7 to 17 can be directed at the desired angle of inclination.

In this embodiment of the present invention, the downstream end wall 6 is in the form of a flattened-cone-shaped outer surface which is symmetrical about the central axis BB.

In the preferred embodiment the downstream end wall 6 includes a plurality of ventilating air passages, shown in the form of radial grooves 23 to 24, for allowing passage of secondary air to a region downstream and radially inward of the nozzle outlets, such as outlet end 18.

The ventilating air passages reduce the tendency of the jets to be drawn towards the centerline and coalesce due to the radial inflow of secondary flow induced by the fluid issuing from the nozzles, particularly with the use of closely spaced nozzles as in the embodiment shown.

In this embodiment of the present invention, one of the snow making, nozzle orifices is replaced by a snow nucleating nozzle orifice 62 extending outwardly through the downstream end wall 6, to an outlet end thereof, along a longitudinal axis CC which is inclined radially outwardly at an angle $\beta$ in the range of about 5° to 15° C. to the central axis BB around which the snow making and the snow making nozzle orifices 7 to 17 are circumferentially spaced, the snow nucleating nozzle orifice 62 having a narrow bore relative to the bores of the snow making nozzle orifices 7 to 17, and having a convergent, cone-shaped inlet portion 64 with an obtuse included angle, an intermediate throat portion 66, and a divergent, cone-shaped outlet portion 68 with an acute included angle. The snow nucleating nozzle orifice 62 is not provided with a water jet nozzle, such as those designated 42 to 47.

The pipe 52 comprising the means for delivering pressurized air to the air compartment 40 provides an air inlet centrally located in the upstream wall 4, and a pipe centrally located in the water compartment 38 and connecting the air inlet to a central opening in the tube plate 36.

As shown in FIG. 1 for water jet nozzle 42, the water jet nozzles, such as those designated 42 to 47, each comprise a water tube having an upstream, tapering bore portion 70 which reduces in cross-sectional area towards a downstream, elongated portion 72 of substantially constant cross-sections for, in operation, directing a narrow jet of water into a central portion of the snow making, nozzle orifice associated therewith.

In the tests to verify the present invention each snow making nozzle orifice 7 to 17 had a convergent cone-shaped inlet portion, such as portion 19, which had a maximum diameter of 19.05 mm and an included angle of 120°, each throat portion, such as portion 20, had a diameter of 4.76 mm and a length of 1.59 mm, and each divergent, cone-shaped outlet portion, such as portion 22, had an included angle of 10°.

On the basis of tests conducted it appears that the water jet nozzles should have an outlet orifice diameter in the range of from 0.11 to 0.14 inches, and that the snow making nozzle orifices should have a throat diameter of from 0.17 to 0.20 inches. With larger sizes atomization of the water jets becomes less efficient. With smaller sizes a greater number of nozzles would be required for the same capacity.

In operation, pressurized air is delivered to the air compartment 40 along the pipe 52 while pressurized water is delivered through the inlet 50 to the water compartment 38.

The water is directed as jets by the water jet nozzles, such as those designated 42 to 47, into central regions of the snow making nozzle orifices 7 to 17, while jackets of pressurized air surround the jets and atomize the water as it passes along and emerges from the divergent outlet portions, such as portion 22, of the snow making nozzle orifices 7 to 17, thus causing droplets of the water to be converted into snow.

The snow nucleating nozzle orifice 62 provides snow nucleating ice crystals for the purpose of ensuring adequate nucleation. As previously stated, the snow nucleating nozzle orifice 62 is not provided with a water jet nozzle. This supersonic nozzle generates ice crystals by the adiabatic expansion of saturated compressed air.

In order to arrive at a snow making nozzle incorporating the concepts outlined a development program was undertaken. A test fixture was designed that allowed several of the design parameters of a nozzle to be changed with different components. Two features of the overall design wore fixed. The nozzle throat size, diameter 0.1875 inches, and the convergent section were established from preliminary calculations based on a preselected flow capacity. The variable features of the test fixture included the following The internal diameter of the water tube could be selected from five available tubes, from 3/32 to 5/32 in 1/64 inch increments. For a given water pressure this allowed the flow to be changed by almost an order of magnitude.

The water tube set back, i.e., the distance from the water tube outlet orifice to the nozzle throat could be varied depending on the placing of three spacers. This allowed the set back distance to be changed in seven discrete steps each of a 0.0625 inch increment.

Nozzle blocks were made to be interchangeable and four divergent angles were selected for investigation. These ranged from 10 to 25 degrees for the included angle of the divergent section.

The nozzle blocks also were made available in different lengths so that this parameter could be investigated. Three nozzle block lengths were machined for each of the angles specified above.

Initial tests carried out with the test fixture were independent determinations of water flow for each of the water tubes and air flow for the convergent-divergent nozzles over a range of fluid pressures. The next phase was the investigation of the two-phase, air/water, turbulent jet produced by the coaxial fluid streams. By visual observation the quality of the atomization was first assessed, this together with measurement of the projection reduced the number of variables to be evaluated for snow making. This phase of the work at above freezing temperatures showed that the shortest length nozzle and the smallest divergent angle nozzle produced superior results with respect to projection and degree of atomization. After having established the preferred nozzle length and divergence angle the water tube internal diameter and setback were investigated. As expected the smallest diameter water tube resulted in the atomizing of a finer spray but only at the disadvantage of a higher air/water ratio. On the other hand the largest water tube degraded the atomization. The mid-size water tube was tested and found to be suitable for further evaluation.

In developing the concepts and the design of this nozzle it had been thought that the outlet orifice of the water tube should be very close to the nozzle throat with only sufficient clearance so that interference with air flow was avoided. It was found from the experimental work that the setback distance was not critical providing only that a minimum was required to eliminate interference with air flow.

The configuration thus established was then tested with a water and compressed air supply over a range of supply pressures and flows within the limits of the test facility. This established a two-phase flow calibration for this nozzle assembly.

The Climatic Engineering Facility of the National Research Council of Canada was used for the evaluation of snow making by this test fixture configuration. This facility provided a sizable cold chamber, approximately 100×20×20 feet in dimensions which limited the height of throw for the two-phase jet and thus the time of flight was less than it would be in natural conditions. Snow making was carried out over a range of temperatures from −20° C. to temperatures approaching 0° C. The density of the snow produced was measured by weighing a standard volume. Measurements were recorded of air and water pressures and flows during each test. The duration of each test was limited by the build up of snow on the cold chamber evaporators. At the maximum water flow rate this limited each test period to about four hours.

TABLE 1

Test Fixture Snow Making
CLIMATIC ENGINEERING FACILITY
SNOW MAKING TESTS

| Date | Nozzle | Temp. | MAWR | Density |
|---|---|---|---|---|
| 8/24/87 | XP10S8 | −7 | 16.1 | 23.0 |
| 8/24/87 | XP10S8 | −7 | 19.1 | — |
| 8/24/87 | XP10S8 | −4 | 26.5 | 24.3 |
| 8/24/87 | XP10S8 | −3 | 16.5 | 20.0 |
| 8/24/87 | XP10S8 | −3 | 16.5 | 34.0 |
| 8/25/87 | XP10S8 | −17 | 14.5 | 19.3 |
| 8/25/87 | XP10S8 | −10 | 15.3 | 22.5 |
| 8/25/87 | XP10S8 | −6 | 15.3 | 28.7 |
| 8/26/87 | XP10S8 | −17 | 6.9 | 26.8 |

MAWR in scfm per US gpm
Density in pounds per cubic foot

A final series of tests on the single nozzle test fixture were carried out during September, 1987 at an Australian ski resort under natural conditions mainly at mild temperatures. These tests were all qualitative in nature due to lack of suitable instrumentation at the site. These tests allowed for snow making with no restriction on the apogee of the projection and the fluid pressures and the flows available permitted a much higher rate of snow production. AT this site the optimum setback distance of the water tube was established.

One of the problems in the snow making industry that has not been resolved satisfactorily is the optimum water flow range of a snow making gun. Once an orifice size is selected for an internal mix nozzle the operating characteristics with respect to air/water ratios available for given fluid pressures are also established. With a fixed orifice size on an internal mix nozzle as the water flow is increased the air flow decreases. This characteristic results in larger drops being formed at higher water flow rates. The desirable flow capacity of a snow making gun should be related to the heat sink capacity of the space envelope into which the drops have been projected. The heat sink capacity of a given space envelope depends on the ambient air dry bulb (D.B.) and wet bulb (W.B.) temperatures and the ventilation rate, i.e., the local wind velocity, although a secondary contribution to heat transfer may arise from the convective plume effect developed from the heat released in snow making.

In order to address this problem a multiple nozzle test fixture was designed that allowed up to 18 nozzles of the design established by the single nozzle test fixture to be installed. The layout of the nozzle location was a six cell inner hexagonal array surrounded by a 12 cell hexagonal formation with equidistant spacing between adjacent cells. In any location either a snow making nozzle or a blank nozzle block could be installed. On a parallel removable plate separating the air and water compartments of this test fixture provision was made for the mounting of 18 water tubes located and indexed to align with the snow making nozzles. The water tubes could be replaced with blanking pieces as required to match the blank nozzle blocks. In addition to changing the number of snow making nozzles, two nucleating nozzles were provided that could be installed in any location in place of a blank nozzle block.

The fabrication of the multiple nozzle test fixture was completed early enough to allow tests to start in December 1987 at the Nakiska site for the 1988 Winter Olympics. A set of instrumented hydrants had been provided during the installation of the snow making compressor and pumping plant. In addition a pair of portable in line flow meters and pressure gauges that could be installed in the air and water lines between the hydrants and the multiple nozzle fixture were available. The snow making plant supplies compressed air at a nominal pressure of 150 psig (10.55 kg/sq.cm. gauge) while the water pumping plant uses up to three stages of multistage pumps to pump water to the mountain top. For the tests that were conducted adjacent to the test hydrants water pressures less than 1000 psig (70.31 kg/sq.cm gauge) were used.

Flow calibration tests were first carried out to establish the co-flow characteristics of the multiple nozzle assembly. For this test twelve snow making and six blank nozzle blocks were installed together with the corresponding number of water tubes.

Snow making tests with the number of nozzles varied between six and eighteen were conducted while observing the quality of the snow produced. From this it was noted that 18 nozzles was grossly excessive for the space envelope while six was somewhat less than what the space envelope would allow. Ultimately nine to twelve nozzles was established as the optimum. Various arrangements of nine nozzles were tried and the delta configuration was initially chosen since this allowed a nucleating nozzle to be installed centered below the delta and simultaneously allowed a compact design.

During the early snow making tests at Nakiska the assembly was tested without a nucleating nozzle as well as with one and two nucleating nozzles. It was not readily apparent that two nucleating nozzles were any more effective than one thus one per assembly was selected.

During January, February and March a number of tests were conducted on the Nakiska ski trails using the portable flow and pressure measuring equipment. These tests were conducted on the multiple nozzle test fixture in the delta configuration with nine snow making nozzles and one nucleating nozzle.

The test results showed that an air/water ratio of smaller magnitude could be used, for the same wet bulb temperature, for the delta configuration gun.

Following the tests at Nakiska during the winter of 1987–88 a prototype was designed and constructed in aluminum incorporating a delta configuration with nine snow making orifices and one nucleating orifice. During subsequent tests in the early winter of 1988–89 it was determined that at high rates of water flow convergence of the jets took place and as a result of these collisions larger drops formed causing wet snow formation some distance from the nozzle. The induced secondary air flow contributed to this convergence.

To eliminate this problem two major changes were subsequently made to the design. The snow making nozzles were splayed outward at an angle of 10 degrees with respect to the longitudinal axis of the assembly. This necessitated changing the water tubes to be coaxial with the expansion nozzles. In addition grooves were provided in the face of the nozzle assembly, between the individual orifices, to allow more secondary air entry to the space within the multiple two phase jets. The configuration of the multiple orifice was changed from the delta or triangular array to a circular arrangement. The number of snow making nozzles was increased from nine to eleven while one nucleating nozzle was provided.

Tests in the late winter of 1988–89 and the early winter season of 1989–90 showed that the modification had eliminated the previously experienced problem.

This modified design is shown in FIGS. 1 and 2, and was fabricated from an aluminum alloy for corrosion resistance and light weight.

I claim:

1. A snow making, multiple nozzle assembly comprising:

a) a tubular casing, b) an upstream end wall sealing an upstream end of the casing, c) a downstream end wall sealing a downstream end of the casing, the downstream end wall having a plurality of snow making, supersonic, air expansion and liquid atomizing, nozzle orifices, each snow making nozzle orifice extending outwardly through the end wall, to an outlet end thereof, along a longitudinal axis which is inclined radially outwardly at an angle in the range of about 5° to 15° to a central axis around which the snow making, nozzle orifices are circumferentially spaced, each snow making, nozzle orifice having a convergent, cone-shaped inlet portion with an obtuse included angle, an intermediate throat portion, and a divergent, cone-shaped outlet portion with an acute included angle, d) a tube plate in the casing and dividing the interior thereof into an upstream water compartment, and a downstream air compartment to the snow making, nozzle orifices, the tube plate having, for each snow making nozzle orifice a circumferentially spaced water jet nozzle aligned therewith, each water jet nozzle having an outlet orifice for, in operation, directing a coherent water jet through the air compartment and along the longitudinal axes of and into a central portion of the snow making, nozzle orifice associated therewith, e) inlet means communicating with the water compartment for receiving pressurized water, and f) inlet means communicating with the air compartment for receiving pressurized air.

2. A nozzle assembly according to claim 1, wherein the downstream end wall defines a cone-shaped outer surface which is symmetrical about the said central axis.

3. A nozzle assembly according to claim 1, wherein said downstream end wall includes a plurality of ventilating air passages for allowing passage of secondary air to a region downstream and radially inward of the nozzle outlets.

4. A nozzle assembly according to claim 3, wherein said ventilating air passages comprise radial grooves in the downstream end wall.

5. A nozzle assembly according to claim 1, further comprising a snow nucleating nozzle orifice extending outwardly through the downstream end wall, to an outlet end thereof, along a longitudinal axis which is inclined radially outwardly at an angle in the range of about 5° to 15° to the said central axis around which the snow making and the snow nucleating nozzle orifices are circumferentially spaced, the snow nucleating nozzle orifice having a narrow bore relative to the bores of the snow making nozzle orifices, and having a convergent, cone-shaped inlet portion with an obtuse included angle, an intermediate throat portion, and a divergent, cone-shaped outlet portion with an acute included angle.

6. A nozzle assembly according to claim 1, wherein the means for delivering pressurized air to the air compartment comprises an air inlet centrally located in the upstream wall, and a pipe centrally located in the water compartment and connecting the air inlet to a central opening in the tube plate.

7. A nozzle assembly according to claim 1, wherein the water jet nozzles each comprise a water tube having an upstream tapering bore which reduces in cross-sectional area towards a downstream, elongated portion of substantially constant cross-section for, in operation, directing a narrow jet of water into a central portion of the snow making, nozzle orifice associated therewith.

8. A nozzle assembly according to claim 1, wherein the water jet nozzles have an outlet orifice diameter of from 0.11 to 0.14 inches.

9. A nozzle assembly according to claim 1, wherein the snow making nozzle orifices have a throat diameter of from 0.17 to 0.20 inches.

* * * * *